US006773009B2

(12) United States Patent
So

(10) Patent No.: US 6,773,009 B2
(45) Date of Patent: Aug. 10, 2004

(54) CONTROL SYSTEM AND METHOD OF MEDIA DISPENSER

(75) Inventor: Sang Young So, Iksan (KR)

(73) Assignee: LG Electronics Inc., Seoul (KR)

( * ) Notice: Subject to any disclaimer, the term of this patent is extended or adjusted under 35 U.S.C. 154(b) by 142 days.

(21) Appl. No.: 09/984,313

(22) Filed: Oct. 29, 2001

(65) Prior Publication Data

US 2002/0053767 A1 May 9, 2002

(30) Foreign Application Priority Data

Nov. 1, 2000 (KR) ..... 2000-64724
Nov. 1, 2000 (KR) ..... 2000-64725

(51) Int. Cl.[7] ..... B65H 7/02

(52) U.S. Cl. ..... 271/259; 271/10.13; 271/111; 271/262; 271/265.01

(58) Field of Search ..... 271/10.01, 10.13, 271/110, 111, 114, 116, 256, 258.01, 259, 262, 265.01, 265.04, 3.17; 209/534, 551

(56) References Cited

U.S. PATENT DOCUMENTS 4,822,018 A * 4/1989 Hain ..... 271/3.2
5,267,826 A * 12/1993 Peters ..... 414/789.9
5,580,046 A * 12/1996 Beaufort et al. ..... 271/3.16
5,915,681 A * 6/1999 Milne ..... 271/12
5,967,506 A * 10/1999 Miki et al. ..... 271/10.13
6,270,010 B1 * 8/2001 Junkins et al. ..... 235/379
6,332,608 B1 * 12/2001 Tamura ..... 271/111
6,406,016 B1 * 6/2002 Ehara et al. ..... 271/12

FOREIGN PATENT DOCUMENTS

JP 10301598 A * 11/1998 ..... G10L/3/02
JP 03327857 A * 8/2000 ..... B65H/3/52

* cited by examiner

*Primary Examiner*—Donald P. Walsh
*Assistant Examiner*—Kaitlin Joerger
(74) *Attorney, Agent, or Firm*—Fleshner & Kim LLP

(57) ABSTRACT

A control system and a method of a media dispenser with which a user can selects preferable media and dispenses preferable kinds of media can broaden the usefulness media and can recollect abnormal media existing in the media feeding path thus to ease the use. The control system includes a driving motor installed at one side of the base plate in which a media cassette is positioned, for generating driving force, a clutch installed at one side of a media pickup part which discharges media stored in the media cassette and connected to the driving motor, for selectively transmitting the driving force generated in the driving motor to the media pickup part and a clutch controlling means for controlling operation of the clutch by turning on/off a power source applied to the clutch so that the media can be discharged from the media cassette consequently.

17 Claims, 7 Drawing Sheets

CONTROL SYSTEM AND METHOD OF MEDIA DISPENSER

BACKGROUND OF THE INVENTION

1. Field of the Invention

The present invention relates to a dispenser and particularly, to a control system and a method of a media dispenser capable of driving a whole system using a driving source and recollecting abnormal media in the whole period of the media feeding path.

2. Description of the Background Art

FIG. 1 is an elevational view showing a conventional media dispenser.

A conventional media dispenser includes a media cassette 202 in which media are stored, a feeding module 204 to which the media stored in the media cassette 202 is fed, a sensing unit 206 sensing whether two or more sheets of media are fed together by sensing the thickness of the media fed through the feeding module 204, a delivery module 208 for transmitting the media passed through the thickness sensing unit 206 to a user and a reject box 210 for recollecting media when two or more sheets of media are fed together in the thickness sensing unit 206.

In the media cassette 202, a media separating part 212 for separating media into each sheet to transmit the stored media into the feeding module 204 is respectively provided.

Here, the media separating part 212 is connected to the first driving motor 214 installed at one side of the feeding module 204 and is operated by receiving driving force of the first driving motor 214.

The feeding module 204 feeds the media transmitted from the media cassette 202 to the thickness sensing unit 206 and is composed of a plurality of pulleys 216, belts 218 and a plurality of rollers 220.

The thickness sensing unit 206 detects whether two or more sheets of media are fed together by sensing the thickness of the media fed through the feeding module 204.

The delivery module 208 has a discharging part 222 to supply the media passed through the thickness sensing unit 206 to the user and it recollects the media in case two or more sheets of abnormal media are fed together and feeds the media to the reject box 210 via a specific process. Such delivery module 208 includes a plurality of pulleys 226, belts 224 and a plurality of rollers 228.

The pulleys and belts of the feeding module 204 and delivery module 208 are driven by the second driving motor 230 installed at one side of the delivery module 208. Namely, the second driving motor 230 is connected with a driving pulley 232 and the driving pulley 232 is connected to the driven pulley 236 and belt 234. The driven pulley 236 is connected to each pulley by the belt and transmits the driving force.

In the conventional media dispenser, the media stored in the media cassette 202 are separated to sheet by sheet by the media separating part 212 and transmitted to the feeding module 204 if the first driving motor 214 is driven. If the second driving motor 230 is driven, the feeding module 204 and the delivery module 208 are driven. Then the media transmitted to the feeding module 204 are fed to the thickness sensing unit 206 by the plurality of pulleys and belts and transmitted to the delivery module 208 after the thickness sensing unit 206 senses whether two or more sheets of media are passed together.

The media fed to the delivery module 208 are fed to the discharging part 222 capable of providing the media to the user by the plurality of rollers and belts and abnormal media or media in case two or more sheets of media are transmitted are recollected to the reject box 210.

However, since the conventional media dispenser is capable of positioning only one media cassette and dispense only predetermined kind of media, additional media dispensers need to be purchased to dispense another kinds of media.

Namely, since sizes of currencies in respective countries are different in case currency is used as the media, the media can not be used in another countries thus to limit the usefulness.

Also, the media can not be recollected in case a power supply is interrupted in use or the media are blocked by erroneous operation in the media feeding path. Accordingly, the system must be reassembled after taking apart the system and taking away the media thus to cause inconvenience and lengthen the operation time.

Also, since the first driving motor for driving the media separation part and the second driving motor for driving the feeding module and the delivery module to separate the media from the media cassette are needed, there was a problem of increasing the manufacturing cost due to using a plurality of motors of relatively high cost.

SUMMARY OF THE INVENTION

Therefore, an object of the present invention is to provide a control system and a method of a media dispenser capable of reducing cost and simplifying structure by driving a whole system using a driving means.

Another object is to provide a media dispenser capable of treating various kinds of media by installing various kinds of media selectively thus to broaden the usefulness.

To achieve these and other advantages and in accordance with the purpose of the present invention, as embodied and broadly described herein, there is provided a control system of a media dispenser comprising a driving motor installed at one side of the base plate in which a media cassette is positioned, for generating driving force, a clutch installed at one side of a media pickup part which discharges media stored in the media cassette and connected to the driving motor, for selectively transmitting the driving force generated in the driving motor to the media pickup part and a clutch controlling means for controlling operation of the clutch by turning on/off a power source applied to the clutch to consequently discharge the media from the media cassette.

The clutch is formed using the solenoid method which transmits or cuts off the power to or from the media pickup part according to the on/off of the power source.

The clutch controlling means includes a feed sensor installed at one side of the media feeding part to which the media discharged from the media pickup part are fed, for sensing passage of the media, an eject sensor installed at one side of a media discharging part from which the media fed through the media feeding part are discharged to outside, for sensing the media discharged to the media discharging part and a controlling part for turning off the clutch according to electric signals applied from the feed sensor and turning on the clutch according to signals applied from the eject sensor.

The feed sensor includes a light-emitting part installed at a certain position in the media feeding part, for irradiating light and a light-receiving part positioned at a certain interval with the light-emitting part, for sensing light irradiated from the light-emitting part and transmitting the electric signal to the controlling part and counts the number of media being fed and generates clutch-off signals.

The eject sensor includes a light-emitting part installed at one side of the passage in which the media of the media discharging part, for irradiating light and a light-receiving part positioned at a certain interval with the light-emitting part, for sensing light irradiated from the light-emitting part, counts the number of media being discharged through the media discharging part to outside and generates clutch-on signals.

The control method of the media dispenser includes a first step of discharging the media stored in the media cassette by the operation of the media pickup part after the driving motor is driven and the clutch is turned on by applying a power from a power supply unit, a second step of determining whether the media discharged from the media cassette is reached to the first point which is a certain position of the media feeding part while the media are fed though the media feeding part, a third step of cutting-off a driving force transmitted to the media feeding part by turning off the clutch if it is judged that the media reach to the first point, a fourth step of judging whether the media passed through the first point reach to the second point of the media feeding part while the media are fed through the media feeding part and a fifth step of repeating the media discharging process and transmitting the driving force to the media pickup part by turning on the clutch if it is judged that the media reach to the second point.

The first point is a position where the fed media are sensed by the feed sensor of the media feeding part.

The second point is a position where the discharged media are sensed by the eject sensor of the media discharging part.

The control system includes the driving motor positioned at one side of the base plate in which the media cassette is positioned, for generating a driving force, the clutch installed at one side of the media pickup part for discharging media stored in the media cassette and connected to the driving motor, for selectively transmitting the driving force generated by the driving motor to the media pickup part, a sub media cassette unit installed at the lower side of the base plate as a plural number by selection of the user, for accommodating the sub media cassette containing different kinds of media from those stored in the media cassette, a displaying part installed at one side of the base plate, for allowing the user to select preferable media and the controlling part for discharging the selected media by turning on/off the clutch selected either of said clutch or the sub clutch installed in the sub media cassette unit according to signals of the displaying part.

The sub media cassette unit includes a case installed at the lower side of the base plate, for receiving therein a sub media cassette, an upper pulley connected to the base plate, for receiving a power from the driving motor, a sub lower pulley connected to the upper pulley by a timing belt, a sub media pickup part connected with the sub lower pulley, for transmitting the media stored in the sub media cassette by receiving rotational force and a sub media feeding part for transmitting the media transmitted from the sub media pickup part to the media feeding part by guiding the media to the upper direction.

The control system includes the reject box positioned at the front side of the base plate in which the driving motor is positioned, for storing abnormal media, the diverter installed at one side of the media feeding path, for recollecting the abnormal media to the reject box and a media rejection controlling means for recollecting the abnormal media to the reject box by operating the diverter, when abnormal media are generated in the feeding process or two or more sheets of media are fed together.

The diverter is installed between the media feeding part in which media are fed and the media discharging part in which the media are discharged rotatably and has a solenoid for operating the diverter according to electric signals of the media rejection controlling means.

The rejection controlling means includes a feed sensor installed at one side of the media feeding part, for sensing media, a thickness sensor installed at the upper side of the feed sensor, for sensing the thickness of the media, a slit sensor installed at one side of the media feeding part, for detecting feeding speed of the media, an eject sensor installed in the media discharging part, for sensing the discharged media, a reject sensor installed at one side of the reject box, for sensing the recollected media and a controlling part for turning on/off the driving motor and the solenoid according to signals of the respective sensors.

The slit sensor includes a rotating plate installed at one side of the media feeding part and rotated at the same feeding speed as that of the media feeding part and having a plurality of slits in the circumferential direction and a slit detection part positioned at one side of the rotating plate, for applying electric signals to the controlling part by detecting the number of the slits according to the rotation of the rotating plate.

The reject sensor includes a light-receiving part and a light-emitting part which are installed at one side of the passage where the media are recollected to the reject box.

The control method includes a first step of rotating the driving motor as much as a certain width in the regular or reverse direction if the power source of the media dispenser is turned on, sensing whether abnormal media exist in the media feeding path and recollecting the abnormal media if it is judged that abnormal media exist, a second step of performing media discharging operation by operating the driving motor normally when the recollecting operation of the abnormal media is completed or there is no abnormal media in the first and second periods, a third step of judging whether two or more sheets of media are fed together in the third step and a fourth step of recollecting the abnormal media to the reject box by operating the diverter when it is judged that two or more sheets of media are fed together in the third step.

The first step includes a step of judging whether abnormal media exist in the second period by reversely rotating the driving motor as much as the certain rotation number, a step of rotating the driving motor regularly and recollecting the abnormal media to the reject box by operating the diverter after moving the abnormal media to the front of the diverter by reversely rotating the driving motor as much as the certain rotation number if it is judged that the abnormal media exist in the second period, a step of judging whether the abnormal media exist in the first period by regularly rotating the driving motor as much as the certain rotation number if the recollection of the abnormal media is completed, a step of regularly rotating the driving motor and recollecting the abnormal media to the reject box by operating the diverter when it is judged that the abnormal media exist in the first period, a step of repeatedly judging whether the abnormal media exist in the first and second periods by increasing the rotation number of the driving motor step by step when the recollection of the abnormal media is completed and a step of recollecting the abnormal media to the reject box by driving the driving motor and the diverter if it is judged that the abnormal media exist.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which will be illustrated in the accompanying drawing.

Figure 1:
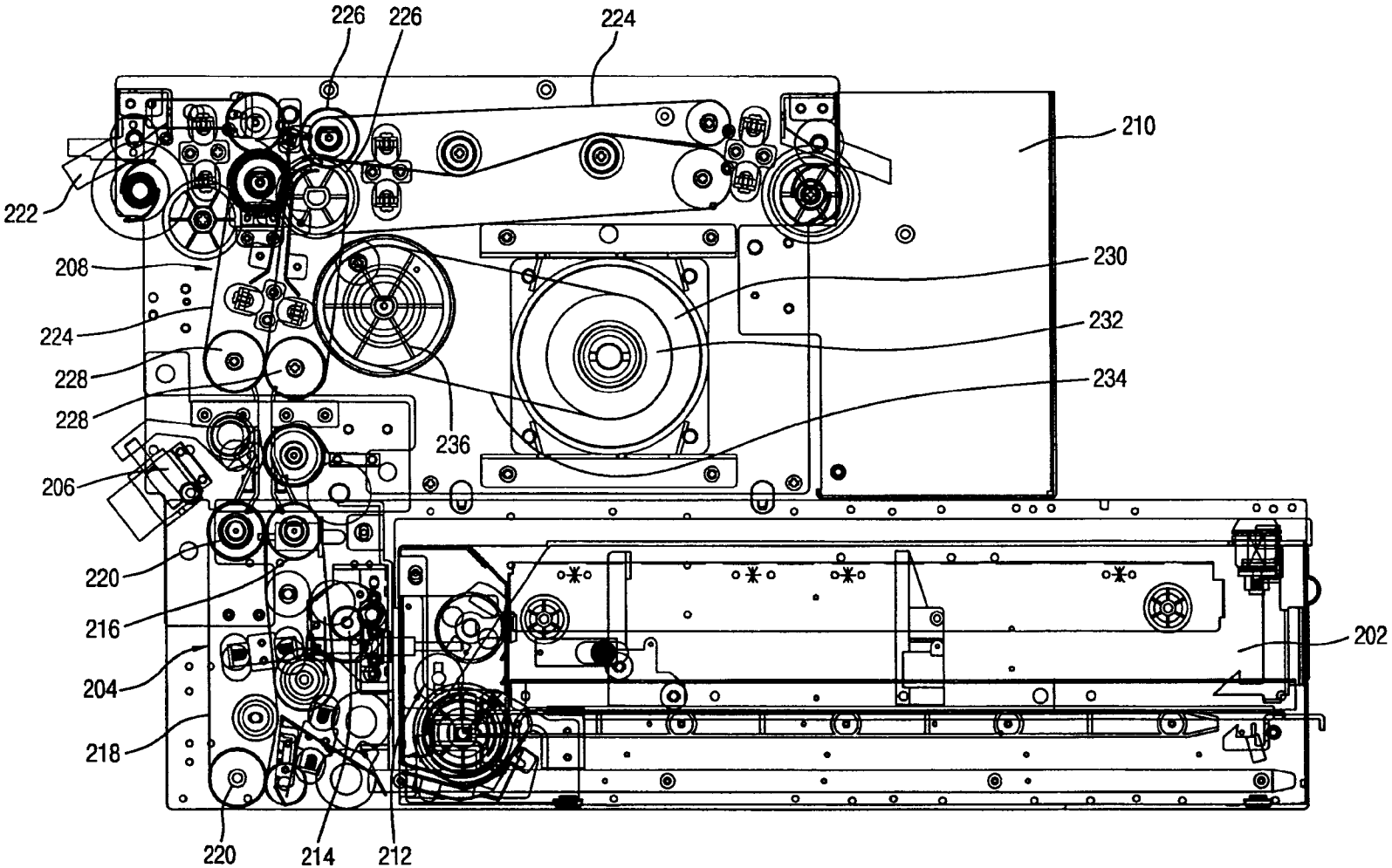
FIG. 1 PRIOR ART
FIG. 1 is an elevational view showing a conventional media dispenser.
Figure 2:
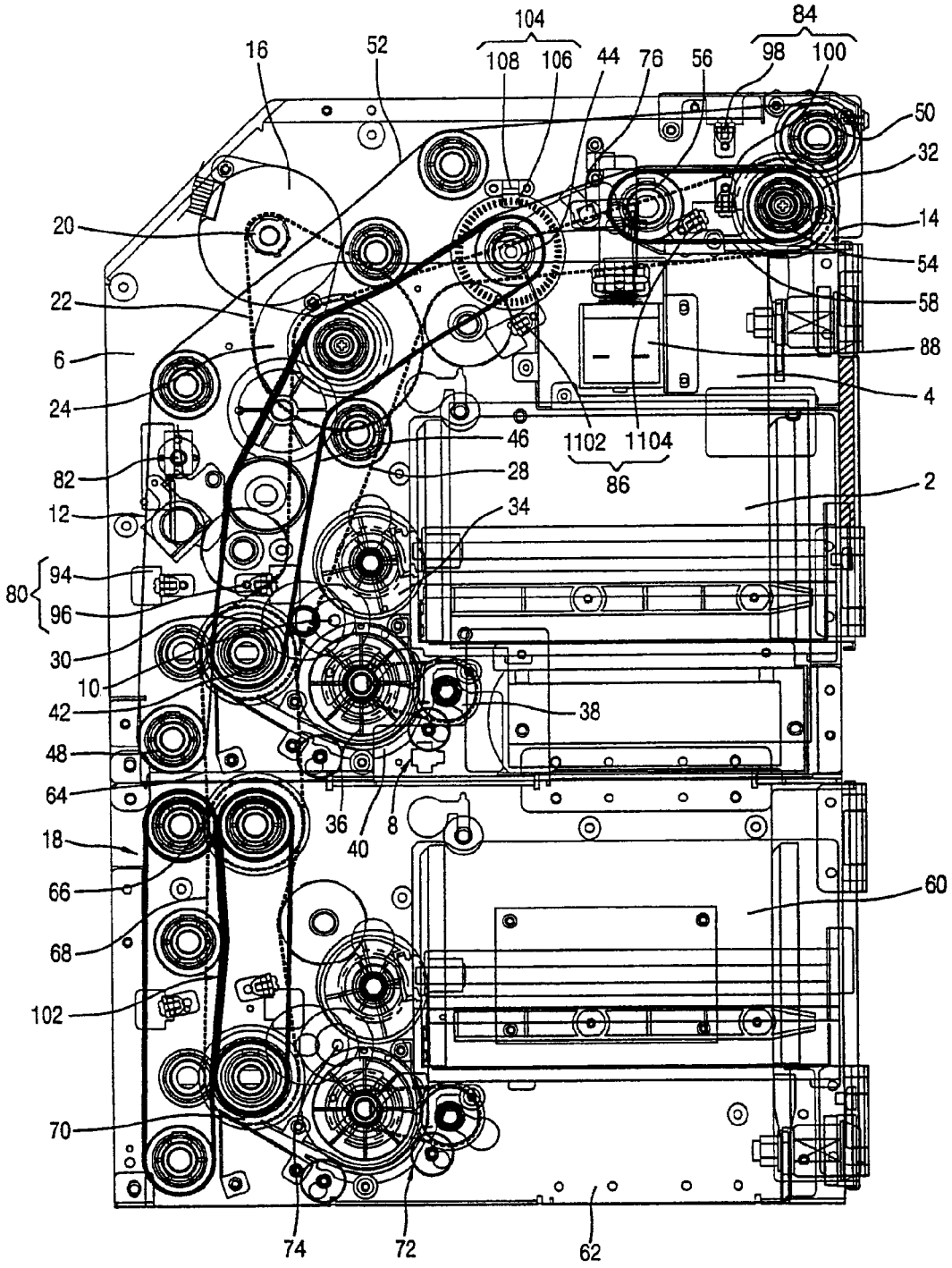
FIG. 2 is an elevational view showing a media dispenser in accordance with the present invention.
Figure 3:
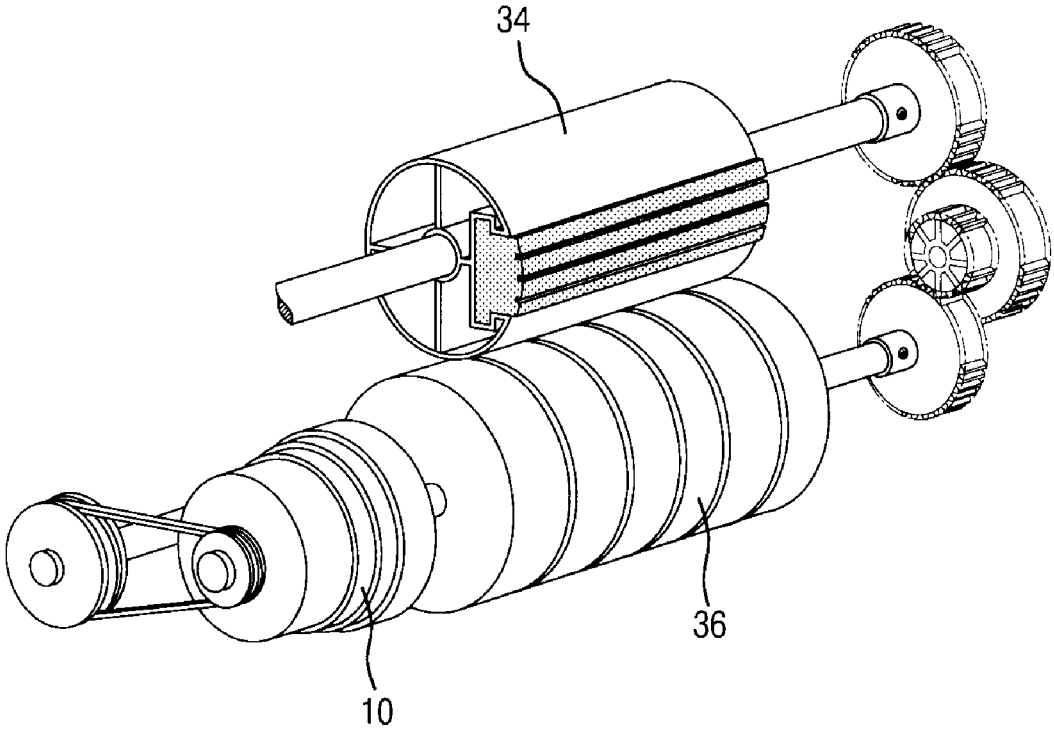
FIG. 3 is a perspective view showing a media pickup part of the media dispenser in accordance with the present invention.

FIG. 2 is an elevational view showing a media dispenser in accordance with the present invention.

The media dispenser in accordance with the present invention includes a base plate 6 in which a media cassette 2 in which media are stored and a rejected box 4 for collecting inferior media are received, a media pickup part 8 installed at the lower side of the base plate 6 for discharging the media stored in the media cassette 2 by separating the media sheet by sheet, a media feeding part 12 for feeding the media discharged from the media cassette 2 by the media pickup part 8, a media discharging part 14 for discharging the fed media through the media feeding part 12 to outside, a driving motor 16 installed at one side of the base plate for generating driving force, a power transmitting means for supplying the driving force generated in the driving motor 16 to each system and a sub media cassette unit 18 installed at the lower side of the base plate 6, for storing and discharging different kinds of media.

The media dispenser includes a clutch 10 installed at one side of the media pickup part 8, for transmitting and cutting off power from the power transmitting means to the media pickup part 8, a media rejection means for recollecting abnormal media in the media transmission process or recollecting media in case two or more sheets of media are fed under the condition of being piled up and a controlling means for controlling the on/off of the clutch 10 to consequently discharge the media stored in the media cassette 2, controlling the discharging of the media stored in the sub media cassette unit 18 and controlling the media rejection means.

The power transmitting means includes a driving pulley 20 positioned on the rotation shaft of the driving motor 16 and a driven pulley 24 connected to the driving pulley 20 and the driving belt 22, a lower pulley 30 connected to the driven pulley 24 and timing belt 28, for driving the media pickup part 12 and an eject pulley 32 connected to the driven pulley 24 and timing belt 28, for driving the media discharging part 14.

The lower pulley 30 transmits the driving force generated in the driving motor 16 to the media pickup part 8 and transmits the driving force to the sub media cassette unit 18 in case the sub media cassette unit 18 is added to the base plate 6 to use different media. The lower pulley 30 connected to the media feeding part 12 transmits the rotational force to the media feeding part 12.

The eject pulley 32 transmits the driving force generated in the driving motor 16 to the media discharging part 14 and the media feeding part 12.

The media pickup part 8 includes a pickup roller 34 positioned at the rear side of the media cassette 2, for discharging the media stored in the media cassette 2 in the lower direction by friction, a feeding roller 36 and separating roller 38 positioned at the lower side of the pickup roller 34, for feeding the media discharged by the pickup roller 34 by separating the media sheet by sheet and a guide member 40 for guiding the media fed through the feeding roller 36 and separating roller 38 to the upper direction.

The clutch 10 installed between the feeding roller 36 and the lower pulley 30 connects or disconnects the power transmitted from the lower pulley 30 to the feeding roller 36.

It is desirable that the clutch 10 is formed in the solenoid method which transmits or cuts off the power according to on/off of the power source.

The media feeding part 12 includes a first feeding belt 46 wound between a first feeding roller 42 which is positioned on the identical shaft as the lower pulley 30 and a second feeding roller 44 positioned at the upper side of the base plate 6 and a second feeding belt 52 wound between a third feeding roller 48 which is positioned at the lower side of the base plate 6 rotatably and a fourth feeding roller 50 positioned at the upper front side of the base plate 6 rotatably receiving rotational force from the eject roller 32.

The media feeding part 12 transmits the media discharged from the media cassette 2 to the media discharging part 14 while the first feeding belt 46 and the second feeding belt 52 rotate in the same direction.

The media discharging part 14 includes a first discharging roller 54 which is positioned on the identical shaft as the eject pulley 32 and rotates together, a second discharging roller 56 which is positioned having certain intervals with the first discharging roller 54 and a discharging belt 58 wound between the first discharging roller 54 and the second discharging roller 56.

In the media discharging part 14, the media fed from the media feeding part 12 are moved to between the first feeding belt 46 and the discharging belt 58 while the media discharging part 14 receives the rotational force of the discharging pulley 32 rotating the discharging belt 58.

The sub media cassette unit 18 includes a case 62 installed at the lower side of the base plate 6, for receiving a sub media cassette 60, an upper pulley 66 connected to the lower pulley 30 by a connection belt 64, for receiving a power, a sub lower pulley 70 which is connected to the upper pulley 66 by a timing belt 68 and rotates together, a sub media pickup part 72 connected with the sub lower pulley 70, for transmitting the media stored in the sub media cassette 60 by receiving rotational force and a sub media feeding part 102 for transmitting the media transmitted from the sub media pickup part 72 to the media feeding part 12 by guiding the media to the upper direction.

A sub clutch 74 installed between the sub lower pulley 70 and the sub media pickup part 72 turns on/off the power transmitted from the sub lower pulley 70 to the sub media pickup part 72.

The media rejection means for recollecting abnormal media in the media transmission process or recollecting media in case two or more sheets of media are fed under the condition of being piled up, includes a reject box 4 installed at the upper side of the media cassette 2, for storing abnormal media and a diverter 76 installed between the first feeding belt 46 and the discharging belt 58, for recollecting the abnormal media into the reject box.

The diverter 76 installed at one side of the base plate 6 rotatably converts the feeding process of the media fed in the media feeding part 12 by recollecting the media and has a solenoid for operating the diverter 76 at one side when the power source is applied.

Figure 4:
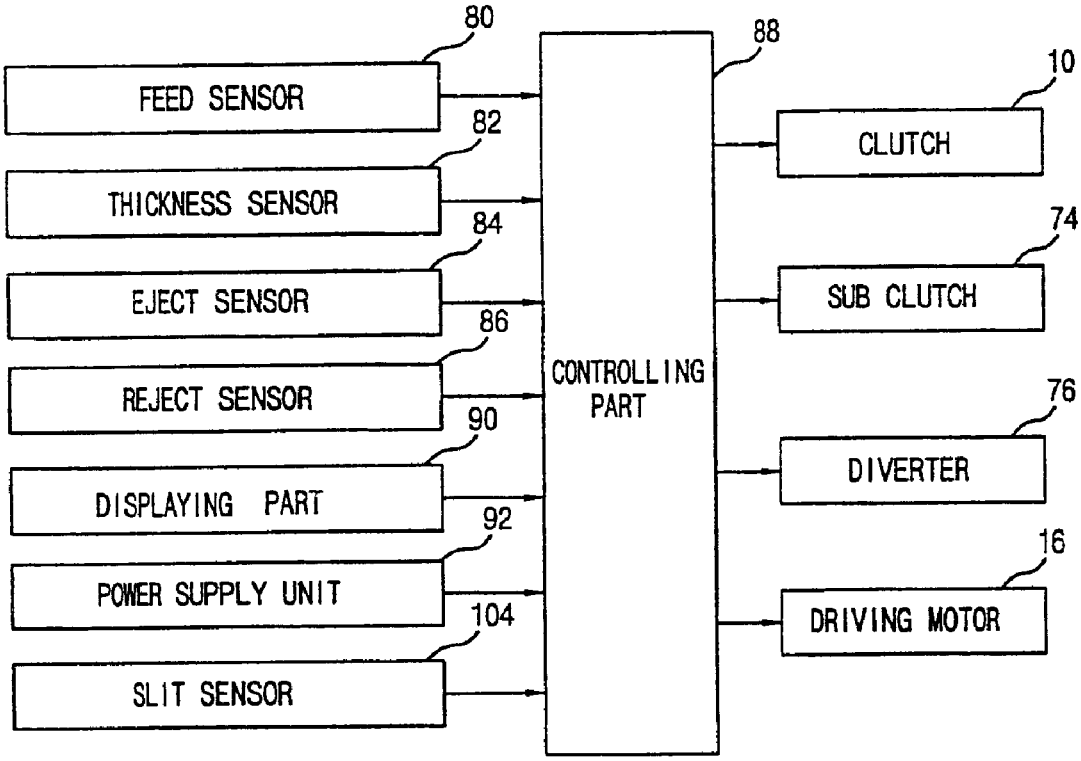
FIG. 4 is a block diagram of the media dispenser in accordance with the present invention.

As shown in FIG. 4, the controlling means includes a feed sensor 80 installed at one side of the media feeding part 12, for sensing media, a thickness sensor 82 installed at the upper side of the feed sensor 80, for sensing the thickness of the media, an eject sensor 84 installed at one side of the media discharging part 14, for sensing media, a reject sensor 86 installed at one side of the reject box 4, for sensing the recollected media, a slit sensor 1104 installed in an upper portion of the media feeding part, for detecting feeding speed of the fed media and a controlling part 88 for operating the sub clutch 74, diverter 76 and the driving motor 16 according to signals of the respective sensors.

The media rejection means for recollecting abnormal media in the media transmission process or recollecting media in case two or more sheets of media are fed under the condition of being piled up, includes a reject box 4 installed at the upper side of the media cassette 2, for storing abnormal media and a diverter installed between the first feeding belt 46 and the discharging belt 48, for recollecting the abnormal media into the reject box.

The diverter 76 installed at one side of the base plate 6 rotatably converts the feeding process of the media fed in the media feeding part 12 by recollecting the media and has a solenoid for operating the diverter at one side when the power source is applied.

As shown in FIG. 4, the controlling means includes a feed sensor 80 installed at one side of the media feeding part 10, for sensing media, a thickness sensor 82 installed at the upper side of the feed sensor 80, for sensing the thickness of the media, an eject sensor 84 installed at one side of the media discharging part 14, for sensing media, a reject sensor 86 installed at one side of the reject box 4, for sensing the recollected media, a slit sensor 104 installed in the upper media feeding part of the thickness sensor, for detecting feeding speed of the fed media and a controlling part 88 for operating the sub clutch 74, diverter 76 and the driving motor 16 according to signals of the respective sensors.

The media dispenser in accordance with the present invention has a displaying part 90 with which a user can input preferable condition and a power supply unit 92 for supplying a power source to the media dispenser.

The feed sensor 80 includes a light-emitting part 94 installed at one side of the media feeding part 12, for irradiating light and a light-receiving part 96 positioned at a certain interval with the light-emitting part 94, for sensing light irradiated from the light-emitting part 94 as a light sensor, counts the number of transmitted media from the media cassette 2 and senses the length of the media by sensing whether the media pass through between the first feeding belt 46 and the second feeding belt 52.

Namely, if the feed sensor 80 is blocked when media pass and the light irradiated at the light-emitting part 94 is interrupted by the media, the light-receiving part 96 applies the electric signals to the controlling part 88 by sensing it.

The thickness sensor 82 positioned at the upper side of the feed sensor 80 is a sensor for applying the signals to the controlling part 88 by detecting the thickness of the media passed through the feed sensor 80 and it prevents the media from being fed under the condition that two or more sheets of media are fed together. The thickness sensor 82 is operated in an instrumental mechanism and has an identical structure as the commonly used thickness sensor.

The eject sensor 84 comprising a light-emitting part 98 installed at one side of the media discharging part 14, for irradiating light and a light-receiving part 100 positioned at a certain interval with the light-emitting part 98, for sensing light irradiated from the light-emitting part 98, applies the electrical signal to the controlling part 88 by sensing the media discharged through the media discharging part 14 to outside.

The eject sensor 84 counts the number of media discharged to outside and applies the signal for turning on the clutch 10 to the controlling part 88.

The reject sensor 86 which is a light sensor includes a light-receiving part 1102 and a light-emitting part 1104 which are installed on the upper media rejection passage of the reject box 4 at a certain interval and counts the currency recollected to the reject box 4 according to the operation of the diverter 76.

According to the electric signal of the reject sensor 86, the controlling part 88 counts the number of media recollected to the reject box 40 and checks the operation of the diverter 76.

The slit sensor 104 includes a rotating plate 106 which is installed the same shaft as the second media feeding roller 44 and rotated having a plurality of slits in the circumferential direction and a slit detection part 108 positioned at one side of the rotating plate 106, for applying electric signals to the controlling part 88 by detecting the number of the slits according to the rotation of the rotating plate 106.

The operation to control the clutch by the controlling means having the above composition will be described as follows.

Figure 5:
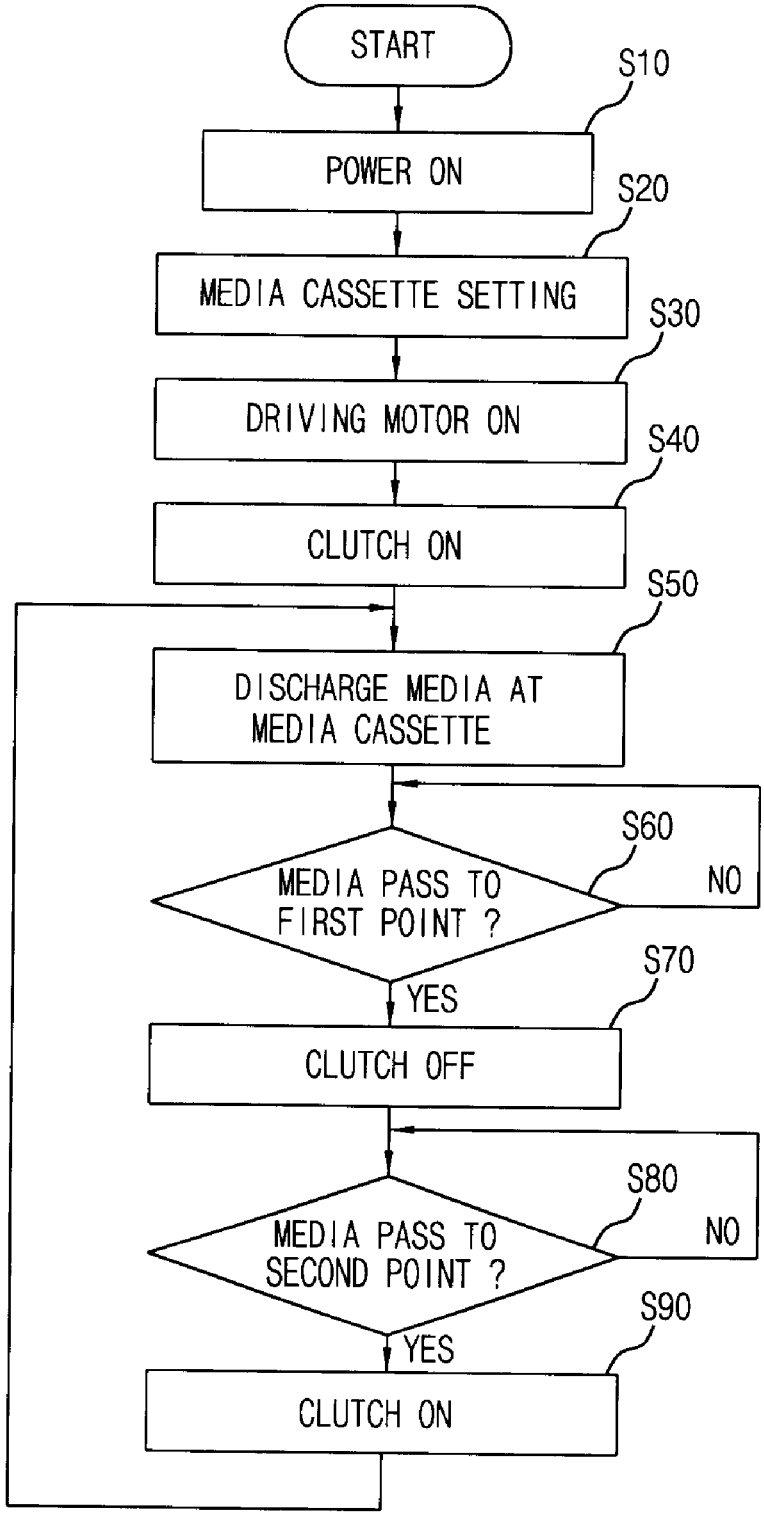
FIG. 5 is a flow chart illustrating a clutch control method of the media dispenser in accordance with the present invention.

FIG. 5 is a flow chart illustrating a clutch control method of the media dispenser in accordance with the present invention.

First, a power is supplied to a user by turning on the power and selects media which are stored in a preferable media cassette among a plurality of media cassettes (S10 and S20).

Namely, if the user selects preferable media by adjusting the displaying part 90 in case a plurality of sub media cassette units 18 are positioned at the lower side of the base plate 6, the controlling part 88 is set correspondingly. Then the clutch is turned on/off and the other clutches are remained the condition of off to discharge the media from the media cassette in which the preferable media are stored.

For example, in case the media are currencies, if the user selects a currency of a country from which the user wants to withdraw by adjusting the displaying part 90, the controlling part 88 sets the size and thickness of the currency, prepares to turn on/off of the selected clutch and turns off the other clutches.

Under this condition, if the user operates the media dispenser to withdraw the selected currency, the driving motor 16 and the clutch 10 are turned on and the media are discharged from the media cassette 2 (S30, S40 and S50).

Namely, if the power is turned on and the driving motor 16 is driven, the media feeding part 12 and the media discharging part 14 are driven by the power transmitting means. Then, a power source is applied to the clutch 10, the clutch 10 is turned on and the power generated in the driving motor 16 is transmitted to the media pickup part 8. Accordingly, the media pickup part 8 is operated and the media stored in the media cassette 2 are discharged to the media feeding part 12.

In the above, the media cassette 2 judges whether the discharged media reach to the first point while the media are fed through the media feeding part 12 (S60). If it is judged that the media reached to the first point already, the clutch 10 is turned off and the number of fed media are counted (S70).

Namely, if the media transmitted from the media cassette 2 reach to the first point of the media feeding part 12, the feed sensor 80 senses the media an applied the electric signal to the controlling part 88. Then the controlling part 88 turns off the clutch 10 and counts the number of media according to the electric signal of the feed sensor 80.

Here, the first point is a position in which the media fed from the media cassette 2 pass through the feed sensor 80, that is, a certain position where the feed sensor 80 is positioned in the media feeding part 12.

It is judged whether the media passed through the first point is fed through the media feeding part 12 and reach to the second point (S80). Then if it is judged that the media reached to the second point, the media are transmitted from the media cassette 2 by turning on the clutch 10 (S90).

Namely, if the media which passed the feed sensor 80 are fed to the upper direction through the media feeding part 12 and reach to the second point pass the media discharging part 14, the eject sensor 84 senses it, applies the electric signal to the controlling part 88 and transmits a power to the media pickup part 8 by turning on the clutch 10. Then the media are transmitted from the media cassette 2. The controlling part 88 counts the number of media discharged to outside according to the signal of the eject sensor 84.

Here, the second point is a certain position in which the eject sensor 84 is positioned in the media discharging part 14 and a position where the media fed through the media feeding part 12 are detected by the eject sensor 84 when the media pass through the media discharging part 14.

In case the user is willing to discharge the media stored in the sub media cassette 60 of the sub media cassette unit 18, the controlling part 88 turns off the clutch 10, turns on/off the sub clutch 74 and resets the size of the media stored in the sub media cassette 60 and the thickness.

Later, when the driving motor 16 is operated, the upper pulley 66 connected to the lower pulley 30 and the connection belt 64, is rotated and the sub lower pulley 70 connected to the upper pulley 66 and the timing belt 68 rotates together. Accordingly, the driving force of the driving motor 16 is transmitted to the sub media pickup part 72 and the sub media feeding part 102.

Under this condition, if the sub clutch 74 is turned on, the sub media pickup part 72 is driven and accordingly, the media stored in the sub media cassette 60 are fed through the sub media feeding part 102 to the media feeding part 12. The media fed by the media feeding part 12 are discharged to outside through the media discharging part 14.

Since the controlling operation of the sub clutch 74 is identical as that of the clutch 10 above described, the description is omitted.

Hereinafter, media recollecting method by the media rejection means of the media dispenser in accordance with the present invention will be described.

Figure 6:
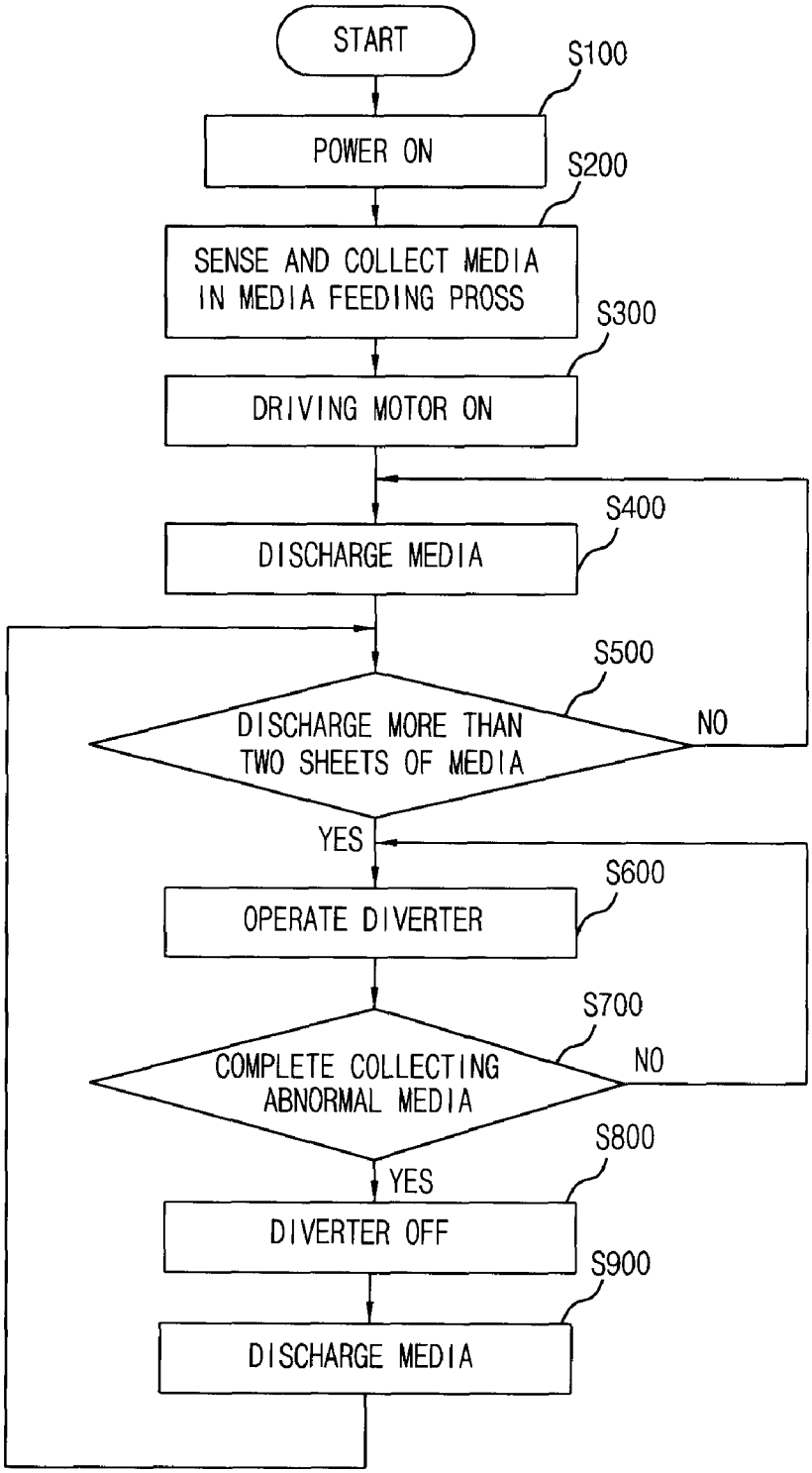
FIG. 6 is a flow chart illustrating a media recollection method of the media dispenser in accordance with the present invention.

FIG. 6 is a flow chart illustrating a media recollection method of the media dispenser in accordance with the present invention.

If the power of the media dispenser is turned on, it is judged whether abnormal media exist in the first and second periods (S100, S200).

Namely, before, the media dispenser is operated normally, it is grasped whether the media exist in the media feeding path due to the generation of a power cut-off by power failure and jam of the media.

The first period is a distance from the media pickup part 8 to the first point of the media feeding part 12 and the second period is a distance from the first point to the second point. Namely, the first period is a period where the media are fed from the media cassette 2 to the position where the feed sensor 80 of the media feeding part 12 is positioned and the second period is a period where the media are fed from the first period to the media discharging part 14.

In the above, if it is judged that the media exist in the media feeding path, the diverter 76 is operated to collect abnormal media. At this time, when the diverter 76 is operated, the clutch 10 is turned off not to discharge the media stored in the media cassette 2.

Hereinafter, the process to grasp whether the abnormal media exist in the media feeding path will be described.

Figure 7:
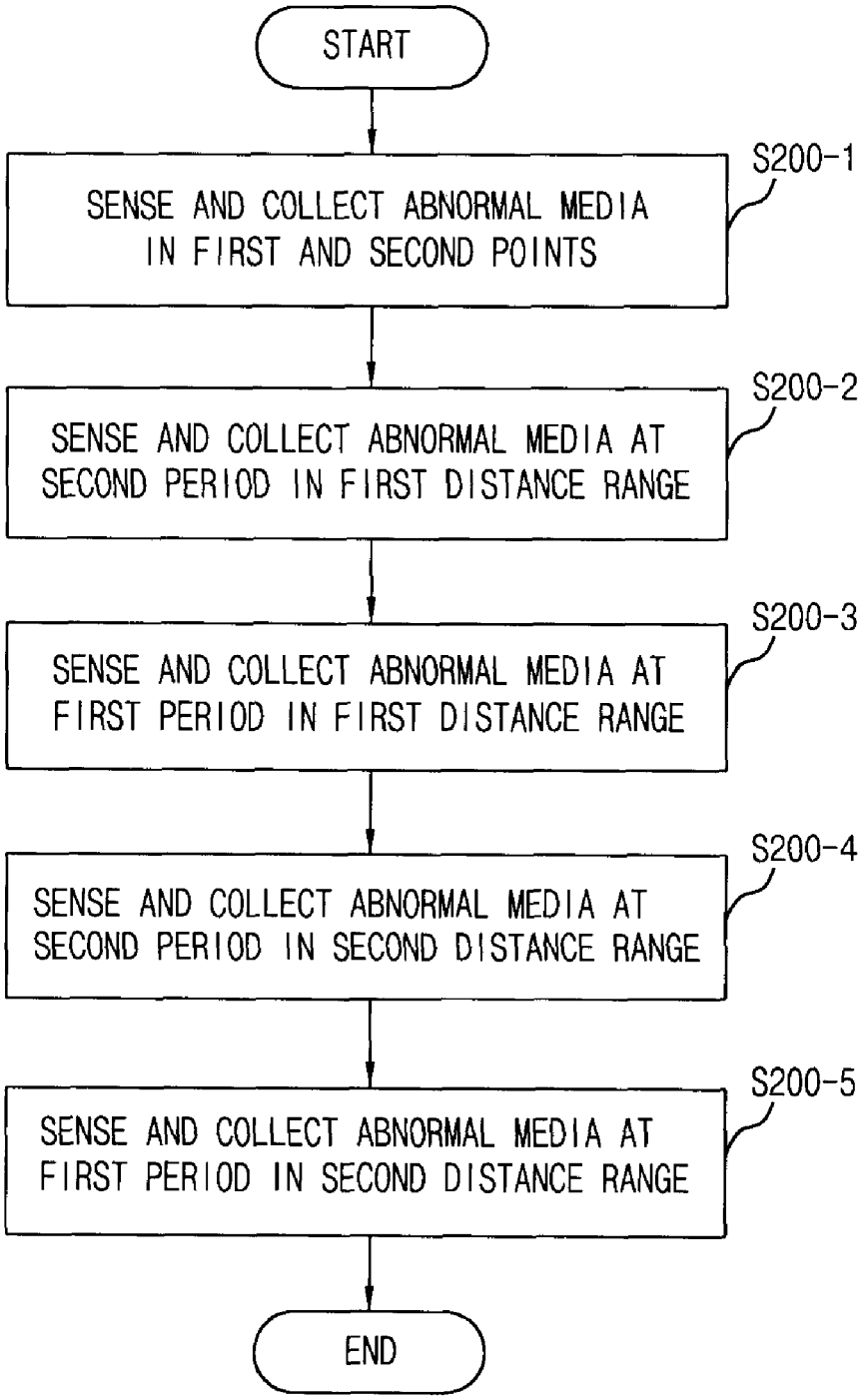
FIG. 7 is a partial flow chart illustrating a media recollection method of the media dispenser in accordance with the present invention.

FIG. 7 is a partial flow chart illustrating a media recollection method of the media dispenser in accordance with the present invention.

If the power of the media dispenser is turned on, it is judged whether the abnormal media exist at the first and second points and if the abnormal media exist, recollecting operation is performed (S200-1).

In detail, the feed sensor 80 installed at the first point detects whether the abnormal media exist, the eject sensor 84 detects whether abnormal media exist and the electric signal is applied to the controlling part 88.

Then the controlling part 88 rotates the driving motor 16 in the regular direction and recollects the abnormal media at the first point to the reject box 4 by operating the diverter 76 if it is judged that the media exist at the first point according to the electric signal applied from the feed sensor 80.

The controlling part 88 moves the abnormal media in the media discharging part 14 to the media feeding part 12 by rotating the driving motor 16 in the reverse direction, rotates the driving motor 16 in the regular direction again and recollects the abnormal media at the second point to the reject box 4 by operating the diverter 76 if it is judged that the media exist at the second point according to the electric signal applied from the eject sensor 84.

The controlling part 88 grasps whether the abnormal media exist in different positions from the media feeding path by rotating in the regular or reverse direction repeatedly as many times as a certain rotation number of the driving motor 16 if it is judged that the recollecting operation is completed or the media do not exist at the current position according to the electric signal applied from each sensor.

In detail, if the driving motor 16 rotates in the reverse direction according to the controlling part 88, the first and second feeding belts 46 and 52 are moved in the reverse direction as far as the first distance and accordingly, the feed sensor 80 senses whether the abnormal media exist in the second period.

In the above, if it is judged that the abnormal media exist in the second period, the abnormal media are moved to the front side of the diverter 76 by rotating the driving motor 16 reversely, the driving motor 16 is rotated in the regular direction again and the abnormal media are recollected to the reject box 4 by operating the diverter 76 (S200-2).

It is desirable that the first distance is about 10mm and the distance can be set differently according to the characteristic of product.

When the operation is completed, the controlling part 88 grasps whether the abnormal media exist in the first period by rotating the driving motor 16 as many times as a certain rotation number and then the recollection operation is performed if the abnormal media exist in the first period (S200-3).

Namely, the driving motor 16 rotates as many times as a certain rotation number according to the signal of the controlling part 88, the first and second feeding belts 46 and 52 move in the regular direction as far as the first distance and the abnormal media in the first period are sensed by the feed sensor 80.

If it is judged that the abnormal media exist in the first period according to the electric signal applied from the feed sensor 80, the controlling part 88 rotates the driving motor 16 in the regular direction and recollects the abnormal media by operating the diverter 76.

The controlling part 88 rotates the driving motor 16 in the reverse direction again. At this time, if it is judged that the abnormal media exist after grasping the abnormal media existing in the second period by moving the first and second feeding belts 46 and 52 as far as the second distance in the reverse direction by increasing the rotation number of the driving motor 16, the recollecting operation is performed (S200-4).

Then the controlling part 88 rotates the driving motor 16 in the regular direction. At this time, if it is judged that the abnormal media exist after detecting the abnormal media in the first period by increasing rotation number of the driving motor 16 and moving the first and second feeding belt 46 and 52 as far as the second distance in the reverse direction, recollecting operation is performed by operating the diverter 76 (S200-5).

The abnormal media existing in the media feeding path are recollected before operating the media dispenser regularly. At this time, accuracy can be improved by operating rotation of the driving motor 16 in the regular/reverse direction repeatedly and it can be grasped whether the abnormal media exist in the whole period of the media feeding path by increasing the moving distance of the regular/reverse direction of the first and second feeding belts 46 and 52.

If it is judged that the recollecting operation of the abnormal media existing in the media feeding path is completed or abnormal media do not exist is the media feeding path, the media are discharged from the media cassette 2 normally by the media pickup part 8 by driving the driving motor driving motor 16 normally and operating the on/off of the clutch 10 and the media are discharged to outside through the media discharging part 14 (S300 and S400).

In the media discharging process, if it is judged that two or more sheets of media are fed from the media cassette 2 together, the clutch 10 is turned off and the abnormal media are recollected to the reject box 4 by operating the diverter 76 (S500 and S600).

The recollecting method will be described in detail as follows.

If the media fed from the media cassette 2 pass through the feed sensor 80, the feed sensor 80 applies the signal to the controlling part 88 by detecting the starting and ending points of the passage.

The slit sensor 104 detects the feeding speed of the media and applies the electric signal into the controlling part 88.

The thickness sensor 82 senses the thickness of the fed media and applies the electric signal into the controlling part 88.

Then, if it is judged that the media length value applied from the above sensors is larger after combining the electric signals applied from the slit sensor 104 and the feed sensor 80 and comparing the predetermined media length value and the media length value according to the signal applied by the slit sensor 104 and the feed sensor 80, the controlling part 88 recognizes that a plurality of media are fed and accordingly, recollects the piled abnormal media into the reject box 4 by operating the diverter 76.

The controlling part 88 compares the electric signal according to the media thickness applied from the thickness sensor 82 and the predetermined media thickness value. If the thickness applied from the thickness sensor 82 is larger, the controlling part 88 judges that two or more sheets of media are fed and recollects the media into the reject box 4 by operating the diverter 76 (S700).

In the above, the recollecting operation of the media is completed, the media are discharged normally by turning off the diverter 76.

If the abnormal media are recollected into the reject box 4 by the operation of the diverter 76, the reject sensor 86 senses the recollected media and applies the electric signal into the controlling part 88. Then the controlling part 88 counts the number of media recollected into the reject box 4 and judges that the media recollecting operation is completed thus to perform a normal media discharging operation (S800 and S900).

The control system and the method of the media dispenser in accordance with the present invention with the above composition is capable of discharging various kinds of media by installing a plurality of sub media cassette unit at the lower side of the base plate for storing various kinds of media and broaden the usefulness by discharging the media the user wants selectively.

Also, the media are recollected if the abnormal media exist after checking whether the abnormal media exist in the whole period of the media feeding path before using the media dispenser and if two or more sheets of media are discharged together in the normal operation of the media dispenser or the abnormal media are generated, thus to easing the use.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A media dispenser, comprising:

a media cassette positioned in a base;

a driving motor installed at one side of the base and configured to generate a driving force;

a media pickup part configured to withdraw media from the media cassette and to transfer media to a media feeding part;

a media feeding path extending at least from the media pickup part, through the media feeding part, and to a media discharging part of the media dispenser;

a clutch installed at a side of the media pickup part and coupled to the driving motor, wherein the clutch is configured to selectively transmit the driving force generated by the driving motor to the media pickup part; and a controller configured to control operation of the clutch so as to withdraw media from the media cassette, wherein the controller is configured to detect the presence of abnormal media throughout the media feeding path and to control operation of the drive motor and clutch to clear the entire media feeding path of abnormal media and discharge the abnormal media to a reject box, and wherein the abnormal media are cleared through at least one of normal and reverse rotations of the driving motor.

2. The system of claim 1, wherein the clutch is configured to transmit or to cut power to the media pickup part based on a command from the controller.

3. The system of claim 1, wherein the controller comprises:

a feed sensor installed at a side of the media feeding part and configured to sense the passage of media from the media cassette to the media feeding part;

an eject sensor installed at a side of the media discharging part and configured to sense media discharged through the media discharging part to an outside area; and a controlling part configured to control operation of the clutch based on signals from the feed sensor and from the eject sensor.

4. The system of claim 3, wherein the feed sensor comprises:

a light-emitting part configured to irradiate light; and a light-receiving part positioned a predetermined distance from the light-emitting part, wherein the light receiving part is configured to sense light irradiated by the light-emitting part so as to determine a number of media fed, and to transmit a corresponding signal to the controlling part.

5. The system of claim 3, wherein the eject sensor comprises:

a light-emitting part configured to irradiate light; and a light-receiving part positioned a predetermined distance from the light-emitting part, wherein the light receiving part is configured to sense light irradiated by the light-emitting part to determine a number of media discharged through the media discharging part to an outside area, and to transmit a corresponding signal to the controlling part.

6. A control method for a media dispenser, comprising:

driving a driving motor and engaging a clutch installed at a side of a media pickup part;

detecting the presence of abnormal media throughout an entire media feeding path of the media dispenser, wherein the media feeding path extends at least from the media pickup part, through a media feeding part, and to a media discharging part of the media dispenser;

withdrawing media stored in a media cassette by the operation of the media pickup part;

determining whether the media discharged from the media cassette has reached a first point of the media feeding part as the media are fed though the media feeding part;

cutting off a driving force transmitted to the media feeding part by disengaging the clutch if the media has reached the first point;

determining whether the media has reached a second point of the media feeding part as the media are fed through the media feeding part; and re-engaging the clutch and transmitting a driving force to the media pickup part, and repeating the media discharging process if the media has reached the second point.

7. The method of claim 6, wherein the first point is a position where the fed media are sensed by a feed sensor of the media feeding part.

8. The method of claim 6, wherein the second point is a position where the discharged media are sensed by an eject sensor of the media discharging part.

9. A media dispenser, comprising:

a media cassette positioned in a base;

a driving motor positioned at a side of the base and configured to generate a driving force;

a media pickup part configured to withdraw media from the media cassette and to transfer media to a media feeding part;

a media feeding path extending at least from the media pickup part, through the media feeding part, and to a media discharging part of the media dispenser;

a clutch installed at a side of the media pickup part and coupled to the driving motor, wherein the clutch is configured to selectively transmit the driving force generated by the driving motor to the media pickup part;

a sub media cassette unit installed at a lower side of the base and configured to accommodate at least one sub media cassette, and wherein the at least one sub media cassette is configured to hold different kinds of media from those stored in the media cassette;

a sub-clutch installed in the sub media cassette unit;

a displaying part installed at a side of the base and configured to allow a user to select a type of media; and a controller configured to discharge the selected media by engaging at least one of the clutch and the sub clutch based on signals from the displaying part, wherein the controller is configured to detect the presence of abnormal media throughout the entire media feeding path, to control the driving motor and the clutch to clear the media feeding path of abnormal media and discharge the abnormal media to a reject box.

10. The system of claim 9, wherein the sub media cassette unit comprises:

a case installed at a lower side of the base and configured to receive a sub media cassette;

an upper pulley connected to the base and configured to receive power from the driving motor;

a sub lower pulley connected to the upper pulley by a timing belt;

a sub media pickup part connected to the sub lower pulley and configured to withdraw media from the sub media cassette; and a sub media feeding part configured to transfer media from the sub media pickup part to the media feeding part.

11. A media dispenser, comprising:

a driving motor and media cassette positioned in a base;

a media pickup part configured to withdraw media from the media cassette and to transfer media to a media feeding part;

a media feeding path extending at least from the media pickup part, through the media feeding part, and to a media discharging part of the media dispenser;

a reject box positioned at a front side of the base and configured to store abnormal media;

a controller configured to detect the presence of abnormal media throughout the entire media feeding path, to control the driving motor to clear the media feeding path of abnormal media and discharge the abnormal media to the reject box, wherein the abnormal media are cleared through at least one of normal and reverse rotations of the driving motor; and a diverter installed at a portion of the media feeding path and configured to direct abnormal media to the reject box, wherein the controller is configured to operate the diverter, when abnormal media are encountered in the media feeding path or when two or more sheets of media are fed together.

12. The system of claim 11, wherein the diverter is installed between the media feeding part and the media discharging part, and wherein the diverter comprises a solenoid configured to operate the diverter based on signals from the controller.

13. The system of claim 11, wherein the controller comprises:

a feed sensor installed at a side of the media feeding part and configured to sense media;

a thickness sensor installed proximate the feed sensor and configured to sense a thickness of the media;

a slit sensor installed at a side of the media feeding part and configured to detect a feeding speed of the media;

an eject sensor installed at the media discharging part and configured to sense the discharged media;

a eject sensor installed at a side of the reject box and configured to sense the rejected media; and a controlling part configured to control the driving motor and the solenoid based on signals from the respective sensors.

14. The system of claim 13, wherein the slit sensor comprises:

a rotating plate installed at a side of the media feeding part, wherein the rotating plate is configured to rotate at the same feeding speed as that of the media feeding part, and wherein the rotating plate comprises a plurality of slits formed in the circumferential direction; and a slit detection part positioned at a side of the rotating plate and configured to detect a number of slits based on the rotation of the rotating plate and to apply a corresponding signal to the controlling part.

15. The system of claim 13, wherein the reject sensor comprises a light-receiving part and a light-emitting part installed proximate to the reject box.

16. A control method for a media dispenser, comprising:

rotating a driving motor if a power source of the media dispenser is turned on;

sensing whether abnormal media exist throughout an entire media feeding path of the media dispenser, wherein the media feeding path extends at least from a media pickup part, through a media feeding part, and to a discharging part of the media dispenser, and discharging the abnormal media from the media feeding path;

performing a media withdrawal operation when the discharging operation of the abnormal media is completed or there is no abnormal media in the media feeding path;

determining whether two or more sheets of media are fed together during the withdrawing operation; and diverting the abnormal media to a reject box by operating a diverter when two or more sheets of media are fed together.

17. The method of claim 16, further comprising:

determining whether abnormal media exist in a first portion of the media feeding path extending from a feed sensor of the media feeding part to an eject sensor of the media discharging part by rotating the driving motor in a reverse direction for a predetermined number of rotations so as to position the abnormal media forward of the diverter;

rotating the driving motor normally and diverting the abnormal media to the reject box;

determining whether abnormal media exist in a second portion of the media feeding path extending from the media pickup part to the feed sensor by regularly rotating the driving motor a predetermined number of rotations;

regularly rotating the driving motor and diverting the abnormal media to the reject box when abnormal media exist in the second portion;

repeatedly determining whether abnormal media exist in the first and second portions of the media feeding path by gradually increasing the number of rotations of the driving motor when the recollection of the abnormal media is completed; and diverting the abnormal media to the reject box by driving the driving motor and the diverter if abnormal media exist.

* * * * *